US010737837B2

(12) United States Patent
Spelten et al.

(10) Patent No.: US 10,737,837 B2
(45) Date of Patent: Aug. 11, 2020

(54) DEVICE AND METHOD FOR STORING PRODUCTS

(75) Inventors: Franz-Willi Spelten, Wegberg (DE); Bernd Kluth, Linnich (DE)

(73) Assignee: SIG TECHNOLOGY AG, Neuhausen am Rheinfall (CH)

( * ) Notice: Subject to any disclaimer, the term of this patent is extended or adjusted under 35 U.S.C. 154(b) by 741 days.

(21) Appl. No.: 13/703,268

(22) PCT Filed: May 5, 2011

(86) PCT No.: PCT/DE2011/001054
§ 371 (c)(1),
(2), (4) Date: Feb. 22, 2013

(87) PCT Pub. No.: WO2011/153982
PCT Pub. Date: Dec. 15, 2011

(65) Prior Publication Data

US 2013/0139892 A1 Jun. 6, 2013

(30) Foreign Application Priority Data

Jun. 10, 2010 (DE) ..... 10 2010 023 832

(51) Int. Cl.

| | |
|---|---|
| ***B65D 25/00*** | (2006.01) |
| ***B01F 15/00*** | (2006.01) |
| ***B01F 7/16*** | (2006.01) |
| ***B01F 3/08*** | (2006.01) |
| ***B01F 3/12*** | (2006.01) |

(Continued)

(52) U.S. Cl.
CPC ..... *B65D 25/00* (2013.01); *B01F 3/0853* (2013.01); *B01F 3/1221* (2013.01); *B01F 5/108* (2013.01); *B01F 7/168* (2013.01); *B01F 15/00155* (2013.01); *B01F 2003/0028* (2013.01); *B01F 2215/0006* (2013.01); *B01F 2215/0014* (2013.01); *B01F 2215/0022* (2013.01); *Y10T 137/0318* (2015.04); *Y10T 137/8158* (2015.04); *Y10T 137/86035* (2015.04)

(58) Field of Classification Search
CPC ..... B01F 3/04609; B01F 5/102; B01F 5/104; B01F 5/106; B01F 7/00291; B65D 25/00
USPC ..... 366/102
See application file for complete search history.

(56) References Cited

U.S. PATENT DOCUMENTS 1,371,610 A * 3/1921 Dungan ..... B64C 11/00 416/176
2,244,902 A * 6/1941 Stich ..... C12M 23/44 261/21

(Continued)

FOREIGN PATENT DOCUMENTS

DE 102006011881 9/2007
DE 102008050223 A1 * 4/2010 ..... B01F 3/04609

(Continued)

*Primary Examiner* — Marc C Howell
(74) *Attorney, Agent, or Firm* — Lucas & Mercanti, LLP; Klaus P. Stoffel

(57) ABSTRACT

A method and a device used to store a product inside a receptacle. The product includes a first liquid component and at least a second component. Inside the receptacle, the product is circulated by a conveying apparatus which is positioned in the region of a tubular guide element arranged inside a receptacle. At least one component of the product fed to the receptacle flows first into an internal space of the guide element.

5 Claims, 5 Drawing Sheets

(51) Int. Cl.
*B01F 5/10* (2006.01)
*B01F 3/00* (2006.01)

(56) References Cited

U.S. PATENT DOCUMENTS

| | | | | | |
|---|---|---|---|---|---|
| 2,293,183 | A * | 8/1942 | Walker | B01F 3/04609 | 210/194 |
| 3,804,255 | A | 4/1974 | Speece | | |
| 4,207,180 | A | 6/1980 | Chang | | |
| 4,242,199 | A * | 12/1980 | Kelley | B01F 3/04609 | 210/197 |
| 5,536,875 | A * | 7/1996 | Roby | C07C 51/265 | 562/407 |
| 5,916,491 | A * | 6/1999 | Hills | B01F 3/04609 | 261/120 |
| 5,925,290 | A * | 7/1999 | Hills | B01F 3/04609 | 261/121.1 |
| 2001/0013666 | A1* | 8/2001 | Nomura | B01F 3/04262 | 261/93 |
| 2002/0033543 | A1 | 3/2002 | Batterham et al. | | |
| 2007/0264704 | A1* | 11/2007 | Van Toever | B01F 3/04773 | 435/262 |
| 2008/0118946 | A1* | 5/2008 | Fabiyi | B01F 3/04609 | 435/41 |
| 2011/0192777 | A1* | 8/2011 | Mohr | B01F 3/04609 | 210/198.1 |

FOREIGN PATENT DOCUMENTS

| | | | | |
|---|---|---|---|---|
| EP | 0678328 | A | 10/1995 | |
| EP | 2334605 | B1 * | 12/2014 | B01F 3/04609 |
| GB | 548664 | | 10/1942 | |
| GB | 914215 | A | 12/1962 | |
| WO | 0112307 | | 2/2001 | |
| WO | 2006058410 | | 7/2005 | |

* cited by examiner

DEVICE AND METHOD FOR STORING PRODUCTS

The present application is a 371 of International application PCT/DE2011/001054, filed. May 5, 2011, which claims priority of DE 10 2010 023 832.5, filed Jun. 10, 2010, the priority of these applications is hereby claimed and these applications are incorporated herein by reference.

BACKGROUND OF THE INVENTION

The invention relates to a device comprising a receptacle for storing a product which consists of a first liquid component and at least a second component, wherein a tubular guide element, oriented with its longitudinal axis with a vertical component, is arranged inside the receptacle with a spacing from a base, and a conveying apparatus for the product is positioned in the region of the guide element.

The invention also relates to a method for storing a product inside a receptacle, wherein the product consists of a first liquid component and at least a second component and in which the product is circulated inside the receptacle by a conveying apparatus which is positioned in the region of a tubular guide element arranged inside the receptacle.

Such products can, for example, be foodstuffs. It is, for example, also possible that the second component is liquid too. Examples of such a component are emulsions, and in particular milk. According to another alternative, the second component is solid. This can, for example, be the case with a juice with fruit pieces. Other examples are milk with coconut flakes, milk with cereals, and soups and sauces with chunky ingredients. The chunky ingredients can, for example, be vegetables and/or meat.

When the second component is solid, the second component is typically in the form of particles, wherein an average diameter of these particles can lie within a range of 1 to 40 mm. In special cases, smaller or larger average diameters are also possible.

When it is planned to store products which consist of at least two components, the problem can arise that the second component is not homogeneously distributed indefinitely in the first component and separation phenomena can occur. Depending on the specific weight of the first and second components, it is possible that particles float, on the one hand, or settle, on the other.

SUMMARY OF THE INVENTION

The object of the present invention is therefore to construct a device of the type mentioned at the beginning in such a way that separation of the components is counteracted.

This object is achieved according to the invention in that at least one feed line for at least one component of the product opens out into the guide element.

Another object of the invention is to improve a method of the type mentioned at the beginning in such a way that separation of the components is counteracted.

This object is achieved according to the invention in that a component of a product fed to the receptacle first flows into an internal space of the guide element.

The flow rate inside the guide element is increased by the product flowing into the guide element. Moreover, any separation that has already occurred already during the feeding in of the product is reversed.

Gentle circulation of product is assisted by a spacing of the guide element from a base of the receptacle being approximately 1.3 times an average particle size of the second component.

It also contributes to gentle circulation of the product if the spacing of the guide element from an average filling level of the product is approximately 1.3 times an average particle size of the second component.

Specific filling level conditions are assisted by the receptacle having a filling level measuring means.

It is in particular proposed that the filling level measuring means is connected to a filling level regulating means.

Selective specifying of a direction of flow is facilitated in that at least one directing element for a flow of the product is arranged adjacent to the conveying apparatus.

In order to suit specific properties of the product, it is provided that the conveying direction of the conveying apparatus can be reversed.

Effective blending of fed-in product and product that is already present is assisted by the product fed into the receptacle first flowing into an internal space of the guide element. Separation is, moreover, effectively prevented.

Measurement of the filling level inside the receptacle contributes to an advantageous flow formation.

Exemplary embodiments of the invention are shown diagrammatically in the drawings, in which:

DETAILED DESCRIPTION OF THE INVENTION

Figure 1:
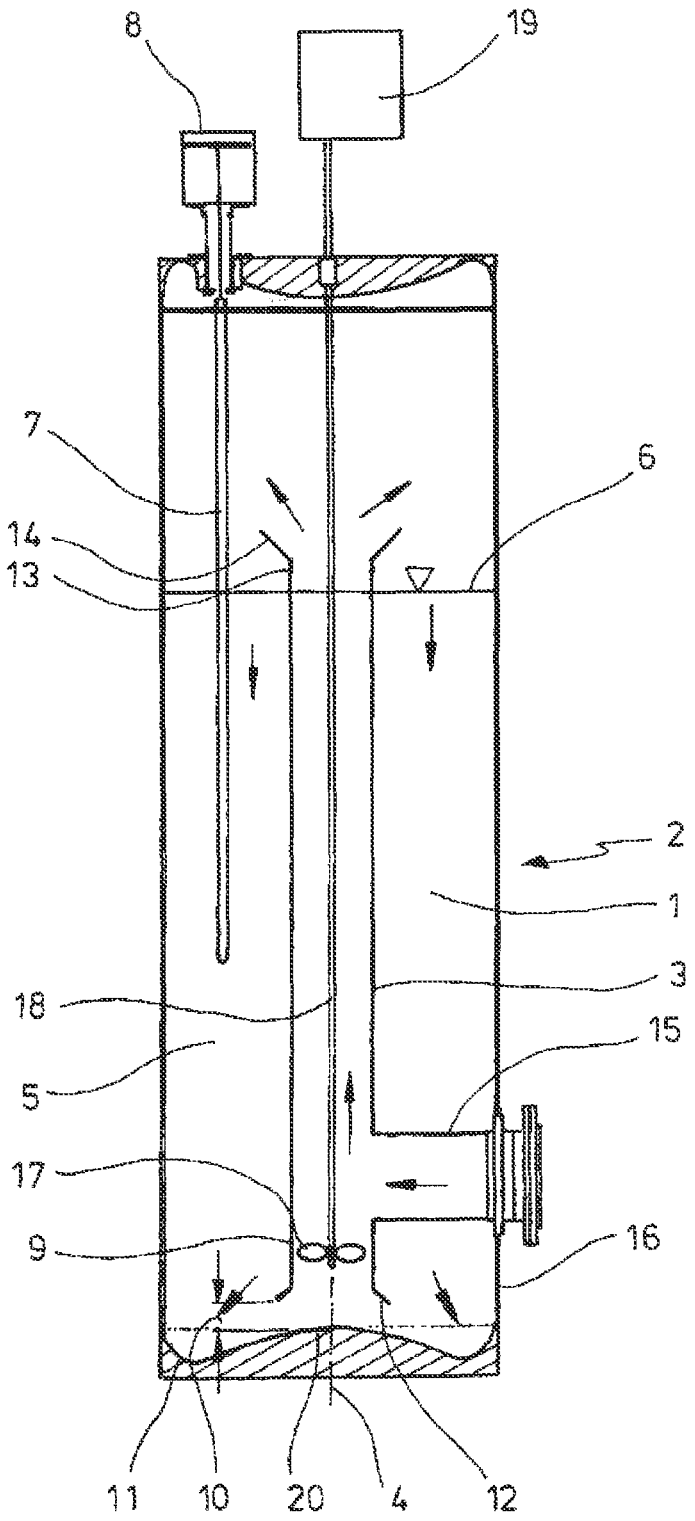
FIG. 1 shows a diagrammatic view in vertical section of the device in an embodiment for a product with sinking particles.

According to the exemplary embodiment in FIG. 1, a tubular guide element (3) is arranged in an internal space (1) of a receptacle (2). The guide element (3) extends essentially vertically with a longitudinal axis (4). In the exemplary embodiment shown, the receptacle (2) has a circular contour in a horizontal sectional plane and the guide element (3) is positioned essentially concentrically inside the receptacle (2).

The internal space (1) serves to receive a product (5) to be stored. Inside the receptacle (2), the product has a filling level (6). A sensor (7) connected to a filling level measuring device (8) serves to detect the filling level (6).

According to an exemplary embodiment, the guide element (3) can have a circular cross-sectional area in a horizontal sectional plane. Other rounded or angular cross-sectional areas are, however, feasible too. A lower end (9) of the guide element (3) is arranged with a spacing (10) from a base (11) of the receptacle (2). In the exemplary embodiment shown, a widening of the cross-section (12) is provided in the region of the lower end (9). FIG. 1 also shows that a widening of the cross-section (14) is made in the region of an upper end (13) of the guide element (3).

A feed pipe (15) for the product (5) opens out into the guide element (3). It is in particular proposed that the feed line (15) is fixed in the region of a wall (16) of the receptacle (2) and that the guide element (3) is held and positioned by the feed pipe (15), as shown in FIGS. 1-6.

A conveying apparatus (17) for the product (5) is arranged inside the guide element (3). The conveying apparatus (17) can take the form of a propeller which is coupled to a drive (19) by a shaft (18).

In the exemplary embodiment shown, the base (11) has a contour (20) such that a central region of the base (11) is arranged at a higher level than peripheral regions of the base (11). The base (11) is thereby curved towards the guide element (3).

The embodiment in FIG. 1 shows a filling level (6) below the upper end (13) of the guide element (3). This embodiment is practical in the case of settling particles.

Figure 2:
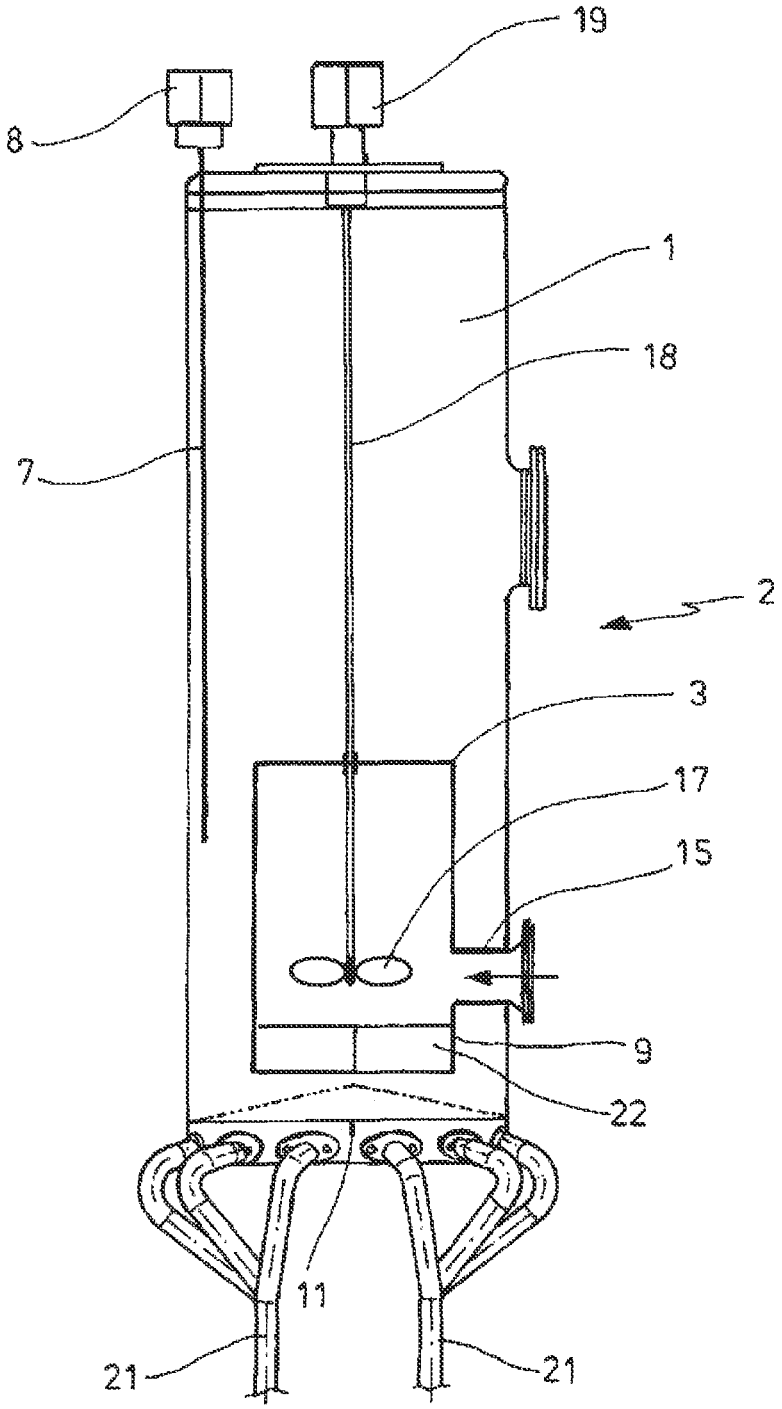
FIG. 2 shows an embodiment that has been modified with respect to FIG. 1.

In the embodiment in FIG. 2, a plurality of filling pipes (21) arranged in the region of the base (11) connect the receptacle (2) to associated filling devices. It can also be seen in FIG. 2 that at least one directing element (22) arranged in the region of the guide element (3) suppresses the formation of rotary flows inside the guide element (3) and promotes the formation of flows in the direction of the longitudinal axis (4). For example, three directing elements (22) in the form of guide plates which are each arranged at 120° relative to one another at the circumference of the guide element (3) can, for example, be arranged in the region of the lower end (9) of the guide element (3).

Figure 3:
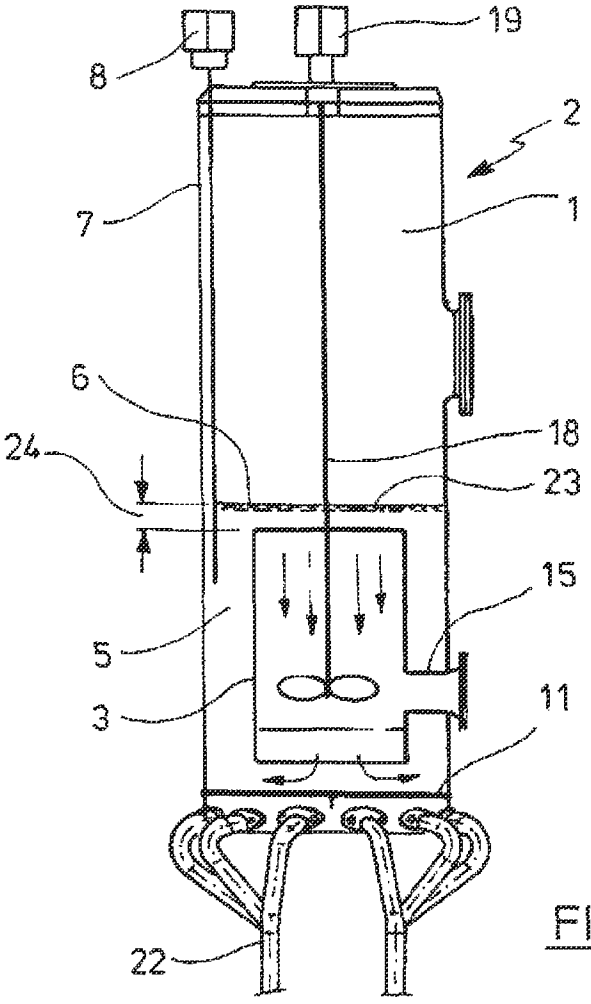
FIG. 3 shows the embodiment in FIG. 2 with a direction of flow inside the guide element from top to bottom.

FIG. 3 shows an embodiment in which the product (5) has a second component (23) with a tendency for floating. This can, for example, be caused by the second component (23) having a lower specific weight than the first component. In the case of such a product (5), a vertical direction of conveying from top to bottom inside the guide element (3) is predetermined. The floating second component (23) is consequently sucked into the guide element (3) and mixed there with the first component. A filling level inside the internal space (1) is approximately 30% of a maximum structural height. The upper end (13) of the guide element (3) has a spacing (24) from the filling level (6).

In the case of floating particles as shown in FIG. 3, a filling level (6) above the upper end of the guide element (3) is required in order to ensure that the floating particles are sucked in and that the resulting mixing is effected. However, the spacing (24) must also not be so large that the suction effect would then be reduced.

Figure 4:
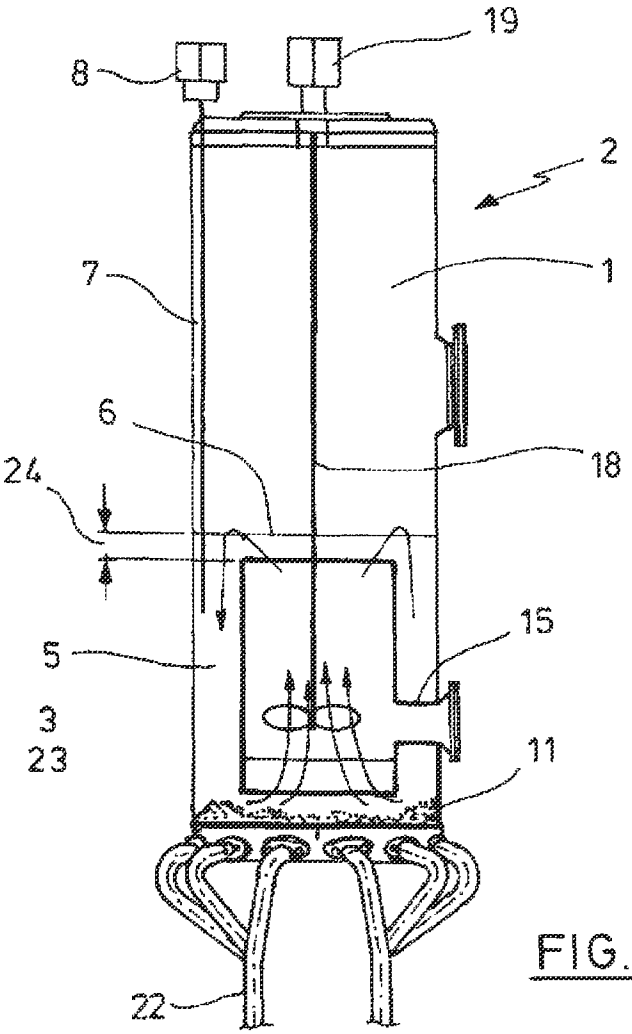
FIG. 4 shows the arrangement in FIG. 3 with a reversed direction of flow.

In the exemplary embodiment in FIG. 4, a product (5) is stored, the second component (23) of which has a tendency to settle. This can, for example, be caused by the second component (23) having a greater specific weight than the first component. When such a product (5) is stored, a vertical direction of conveying from bottom to top inside the guide element (3) is predetermined in order to suck the second component (23) which has settled in the region of the base (11) into the guide element (3) and mix it there with the first component.

Figure 5:
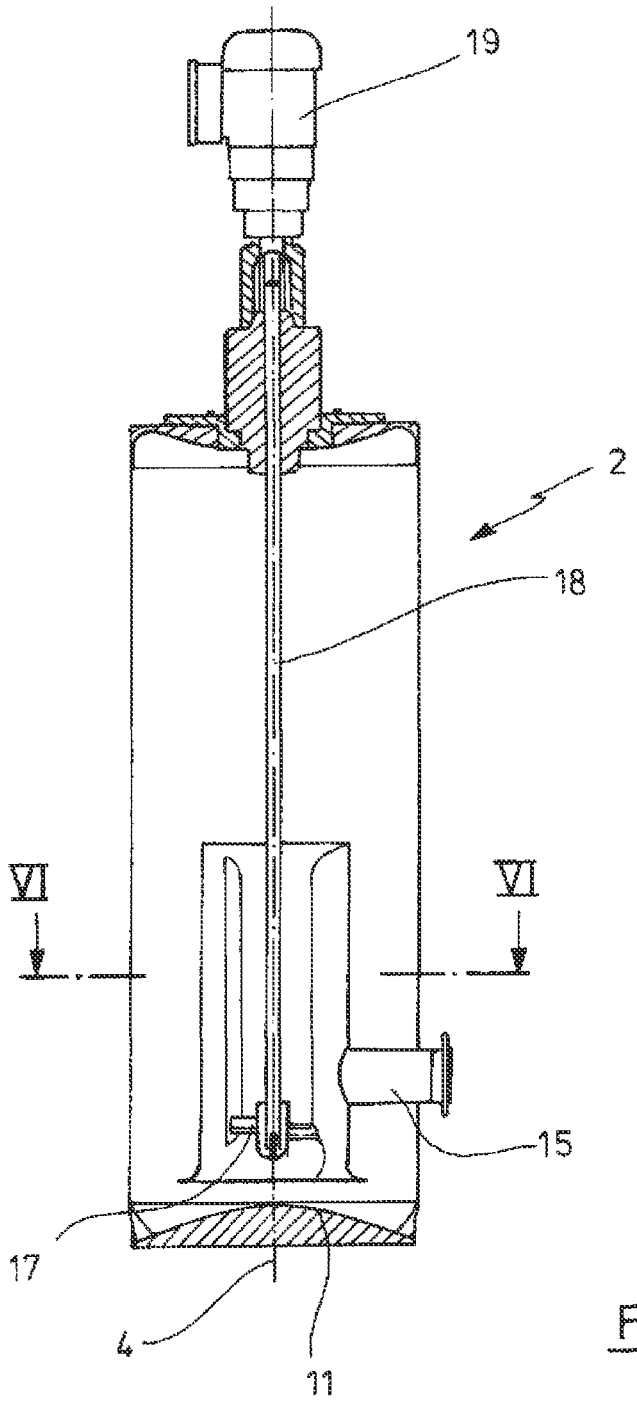
FIG. 5 shows a vertical section through another embodiment of the device.

FIG. 5 shows a view of the receptacle (2) with greater structural detail. The shape of the guide element (3) and the supporting of the guide element (3) by the feed pipe (15) are in particular illustrated again.

Figure 6:
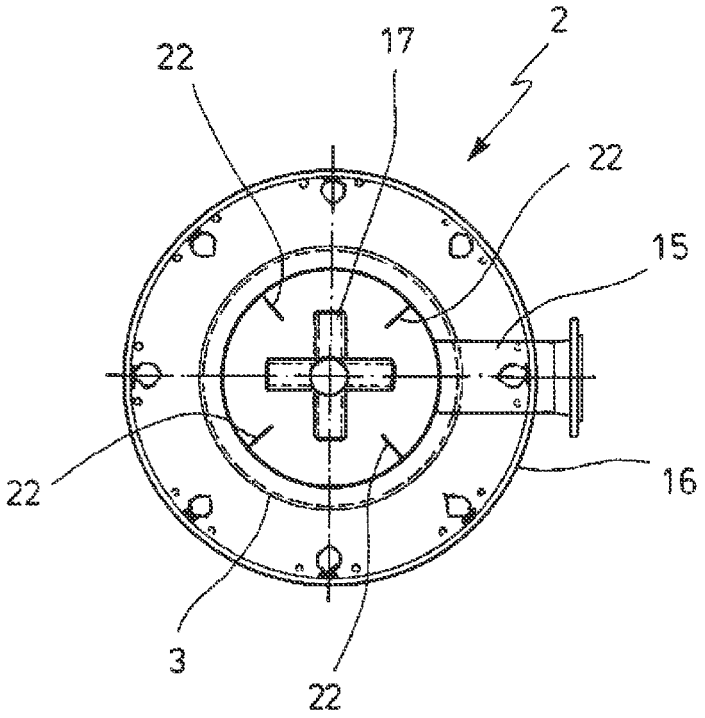
FIG. 6 shows a cross-section along the line of section VI-VI in FIG. 5.

It can be seen from the horizontal section in FIG. 6 that, in the embodiment according to FIG. 5, four directing elements (22) are used which are each arranged at 90° relative to one another in the circumferential direction of the guide element (3). In this exemplary embodiment, the conveying apparatus (17) is provided with four propeller blades.

In the case of a product (5) which has chunky ingredients, the spacing (10) is typically dimensioned such that the spacing (10) is 1.3 times an average particle size. Such a dimensioning has also proved to be expedient for the spacing (24).

In a typical embodiment, the conveying apparatus (17) rotates at approximately 300 revolutions per minute. The drive (19) can be designed with frequency control.

A diameter of the guide element (3) is typically approximately 0.2 to 0.8 times the diameter of the receptacle (2). This refers to the internal diameter in each case. A flow rate of approximately 400 mm/sec is typically generated by the conveying apparatus (17) inside the guide element (3).

The fluctuations in level inside the receptacle (2) which have already been mentioned above can in particular result in continuous feeding of the product or of components of the product, and in discontinuous removal of the product for filling the containers.

When at least two components of the product are fed in separately, it is also possible that the components are mixed only inside the receptacle (2). The individual components of the product are then typically fed in via respective separate feed pipes.

In another embodiment, it is proposed that the guide element (3) is provided along its longitudinal extent with at least one narrowing of the cross-section and that the feeding of the product or the at least one component of the product is provided in this region. A higher flow rate, which helps with blending, is created by the narrowed portion.

The invention claimed is:

1. A device for storing a product, comprising: a receptacle for storing a product which consists of a first liquid component and at least a second component that is a solid, chunky component, the receptacle having a base; a vertical tubular guide element arranged inside the receptacle with a spacing from the base so as to be oriented with a longitudinal axis in a vertical direction; a conveying apparatus for the product, the conveying apparatus including a propeller positioned in a lower region of the guide element so as to create a vertical flow through the guide element to create a suction for transporting the solid component of the product in a vertical direction to an interior of the guide element and so as to mix the first and the second components along the vertical flow through the guide element; and at least one feed pipe for at least one component of the product opens out into an opening in a side wall of the guide element, wherein the feed pipe has an internal cross-section and the opening in the side wall of the guide element has a cross-section equal to the internal cross-section of the feed pipe so that the entire internal cross-section of the feed pipe opens directly into the guide element to enable streaming of the product with the solid components in the interior of the guide element, wherein the at least one feed is fixed in position in a region of a wall of the receptacle and is attached to the tubular guide elements so as to hold and position the tubular guide element whereby the guide element is held by the feed pipe and the feed pipe opens in the guide element in a lower part of the wall of the guide element, wherein the propeller has at least one blade that extends from a shaft in a radial direction, wherein said blade has a shape to effect said suction in the vertical direction, wherein the guide element has a lower end with a first opening directed to the base of the receptacle and an upper end with a second opening directed away from the base of the receptacle, the first opening and the second opening being surrounded by the wall of the guide element, wherein the conveying apparatus includes a motor coupled to the propeller to rotate the propeller in the suction direction, the motor and the propeller being arranged to create a reversible flow direction in the guide element, the guide element having at least one directing element that suppresses formation of rotary flows inside the guide element and promotes formation of flows in the vertical direction, wherein the base of the receptacle has an upper central region with a bulge directed toward the first opening of the guide element, wherein said bulge is surrounded by a circular depression in the base.

2. The device according to claim 1, wherein of the guide element is spaced from the base of the receptacle at a spacing of about 1.3 times an average particle size of the second component.

3. The device according to claim 1, and further comprising a filling level measuring device connected to the receptacle.

4. The device according to claim 3, and further comprising a filling level regulating device connected to the filling level measuring device.

5. The device according to claim 1, wherein a conveying direction of the conveying apparatus is reversible.

* * * * *